United States Patent [19]

Nakao et al.

[11] Patent Number: 4,839,006

[45] Date of Patent: Jun. 13, 1989

[54] SURFACE TREATMENT PROCESS FOR CARBON FIBERS

[75] Inventors: Fujio Nakao; Hirofumi Uno, both of Hiroshima, Japan

[73] Assignee: Mitsubishi Rayon Co., Ltd., Tokyo, Japan

[21] Appl. No.: 199,453

[22] Filed: May 27, 1988

[30] Foreign Application Priority Data

Jun. 1, 1987 [JP] Japan ..... 62-137980

[51] Int. Cl.[4] ..... C25F 5/00

[52] U.S. Cl. ..... 204/130; 204/28; 204/131; 204/132

[58] Field of Search ..... 204/130, 28, 131, 132

[56] References Cited

U.S. PATENT DOCUMENTS 4,729,820 3/1988 Mitchell ..... 204/130

*Primary Examiner*—John F. Niebling
*Assistant Examiner*—David G. Ryser
*Attorney, Agent, or Firm*—Oblon, Fisher, Spivak, McClelland & Maier

[57] ABSTRACT

A process for surface treatment of carbon fiber of which modulus is not lower than 30 ton/mm$^2$, in two steps, which comprises the steps of subjecting a carbon fiber as an anode to a first electrolytic treatment in an aqueous solution of inorganic acidic electrolyte or of neutral salt electrolyte, and then subjecting the treated fiber to a second electrolytic treatment in an aqueous solution of ammonium salt of carbonic acid or of inorganic alkaline electrolyte.

10 Claims, No Drawings

SURFACE TREATMENT PROCESS FOR CARBON FIBERS

FIELD OF THE INVENTION

This invention relates to a novel surface treatment process for carbon fibers.

BACKGROUND OF THE INVENTION

Since carbon fiber reinforced composite materials are light-weight and are strong with high elastic modulus, their use in sporting and leisure goods, or in space and aircraft materials are developing. Conventionally, however, since the adhesion strength between the reinforcing carbon fiber and the matrix resin is insufficient, various surface treatments to activate the fiber surface such as chemical oxidation, vapor phase oxidation, and electrolytic oxidation, have been employed. Among the, the practical is the electrolytic oxidation treatment from the viewpoint of operability and reaction controllability.

A variety of electrolyte have been studied for the electrolytic oxidation treatment. For example, Saito et al disclose in U.S. Pat. No. 4,401,533, an electrolytic oxidation process wherein a carbon fiber as an anode is treated in an aqueous sulfuric acid solution under a specified range of current, voltage, and duration.

Paul. Jr., also discloses in U.S. Pat. No. 3,832,297 an electrolytic oxidation process of a carbon fiber as an anode using an ammonium compound as an electrolyte which completely decomposes at a temperature not higher than 250° C.

In U.S. Pat. No. 4,600,572, Hiramatsu et al disclose a production process of carbon fibers improved in adhesion strength with the resin wherein carbon fibers are subjected to an electrolytic oxidation in nitric acid followed by inactivation treatment.

The present inventors have suggested a two step electrolytic treatment as disclosed in Japanese Patent Application (OPI) No. 124677/86 (the term "OPI" as used herein means a "published unexamined Japanese patent application"), to effect ample surface treatment. In the previous process, however, the effect was insufficient with the carbon fibers having high modulus of not lower than 30 ton/mm$^2$. Further, two-step surface treatments to incorporate nitrogen functional groups into carbon fiber surface are disclosed in Japanese Patent Application (OPI) No. 276075/87 by present inventors and European Patent No. 251491 (Japanese Patent Application (OPI) No. 6162/88) by S. Mitchell. A process to remove off the weak boundary layer on the carbon fiber surface on the other hand, is not given to present.

The demand for high performance carbon fiber is increasing every year. Particularly in the field of aircrafts, the development is headed for high strength and high modulus, reaching carbon fibers having middle modulus of about 30 ton/mm$^2$ as the main current. The development trend for sports and leisure uses is similar that carbon fibers with high modulus of about 40 ton/mm$^2$ and improved composite performance are under development. Inactivation is more used for the carbon fiber surface corresponding to the high modulus trends that the interfacial bond strength between the fiber and the resin is less effected. Conventional surface treatment process for carbon fibers is insufficient, and no optimum surface treatment process for high modulus carbon fibers to give high composite performance (particularlty ILSS, TS⊥, FS⊥, etc.) which is greatly influenced by the interfacial bond strength between the fiber and the resin, is obtained to the present.

SUMMARY OF THE INVENTION

The object of this invention is the improvement of the surface properties of the high modulus carbon fibers which may realize improved composite performance, and thus to provide a novel surface treatment process for carbon fibers.

The introductionof oxygen into the surface is indispensable for increasing the interfacial bond strength between the fiber and the matrix resin, however, too high a treatment level produces many weak boundary parts on the fiber surface by the oxygen introduction, and then leads to a weakened bond strength. The present inventors made studies and completed the invention to introduce into the high modulus carbon fibers as much oxygen as possible without producing weak boundary parts on the fiber surface.

That is, the present invention relates to a process for surface treatment of carbon fiber in two steps, which comprises the steps of subjecting a carbon fiber as an anode to a first electrolytic treatment in an aqueous solution of inorganic acidic electrolyte or of neutral salt electrolyte, and then subjecting the treated fiber to a second electrolytic treatment in an aqueous solution of ammonium salt of carbonic acid or of inorganic alkaline electrolyte.

The present inventors have studied the electrolytes in the electrolytic oxidation, and found that the surface properties of the carbon fiber is greatly influenced by the electrolyte used.

DETAILED DESCRIPTION OF THE INVENTION

Suitable examples of the electrolytes used for the first electrolytic treatment of the present invention are, as inorganic acidic electrolytes, inorganic oxo acids with pH not higher than 7 such as phosphoric acid, nitric acid, and sulfuric acid; and as neutral salt electrolytes, alkali metal salts of oxo acids such as potassium primary phosphate, potassium secondary phosphate, potassium tertiary phosphate, sodium primary phosphate, sodium secondary phosphate, sodium tertiary phosphate, potassium nitrate, sodium nitrate, potassium sulfate, sodium sulfate, potassium hydrogensulfate, and sodium hydrogensulfate, and ammonium salts of oxo acids except for carbonic acid such as ammonium primary phosphate, ammonium secondary phosphate, ammonium tertiary phosphate, ammonium sulfate, ammonium hydrogensulfate, and ammonium nitrate.

Suitable examples of the electrolytes used for the second electrolytic treatment are, as ammonium salts of carbonic acid, ammonium carbonate and ammonium hydrogencarbonate; and as inorganic alkaline electrolytes, alkali metal hydroxides with pH not lower than 7 such as sodium hydroxide and potassium hydroxide, and alkaline earth metal hydroxides such as barium hydroxide, calcium hydroxide, and magnesium hydroxide.

In the electrolytic treatment for the carbon fibers using solely or a mixture of two or more of the following as the electrolyte: inorganic oxo acids with pH not higher than 7 such as phosphoric acid, nitric acid, and sulfuric acid; alkali metal salts of oxo acids such as potassium primary phosphate, potassium secondary phosphate, potassium tertiary phosphate, sodium primary phosphate, sodium secondary phosphate, sodium tertiary phosphate, potassium nitrate, sodium nitrate, potassium sulfate, sodium sulfate, potassium hydrogensulfate, and sodium hydrogensulfate; and ammonium salts of oxo acids except for carbonic acid such as ammonium primary phosphate, ammonium secondary phosphate, ammonium tertiary phosphate, ammonium sulfate, ammonium hydrogensulfate, and ammonium nitrate; though there being more or less difference, oxygen is readily incorporated into the surface of the carbon fiber. For carbon fibers with modulus not higher than 50 ton/mm$^2$, however, too high a treatment level decreases such composite performance as ILSS, FS⊥, TS⊥, etc., which serve as indices of interfacial strength. This is assumably due to the weak boundary layer on the surface formed by the treatment.

The aforesaid electrolytes are characterized by that they give an ipa of not lower than 0.3 $\mu$A/cm$^2$ when measured by the Cyclic Voltammetry method (described in detail later) at the electrolytic oxidation of 1 g of carbon fiber under 60 coulomb. The ipa measured by the Cyclic Voltammetry method represents the oxygen introduction into the surface and the specific surface area, and thus, the ipa of not lower than 0.3 $\mu$A/cm$^2$ indicates a large amount of oxygen introduction together with increased specific surface area due to local etching. This local etching is responsible for the formation of the weak boundary layer on the carbon fiber surface. That is, the increase in the specific surface area measured as high ipa indicates the formation of the weak boundary layer on the carbon fiber surface.

On the other hand, in the electrolytic oxidation of carbon fibers by using solely or a mixture of two or more of the following as the electrolyte: hydroxides of alkali metals with pH not lower than 7 such as sodium hydroxide and potassium hydroxide; ammonium carbonate and ammonium hydrogencarbonate which are ammonium salts of carbonic acid; alkaline earth metal hydroxides such as barium hydroxide, calcium hydroxide and magnesium hydroxide which are used as a mixture in general because of poor solubility in water; and alkali metal hydroxides of pH not lower than 7 such as sodium hydroxide and potassium hydroxide, though the amount of oxygen introduced into the carbon fiber is little, a smooth etching could be effected. For carbon fibers with modulus lower than 30 ton/mm$^2$, surface treatment using the aforesaid electrolytes is sufficiently performed since there exists relatively high amount of oxygen on the surface and the crystalline size of the surface is relatively small, however, when the modulus is 30 ton/mm$^2$ or higher, the composite performance is insufficient since the electrolytes fail to provide ample amount of oxygen. These electrolytes are characterized by that the ipa is lower than 0.3 $\mu$A/cm$^2$ when measured by the Cyclic Voltammetry method described in detail later at the electrolytic osidation of 1 g of carbon fiber with 60 coulomb of electricity. The ipa of lower than 0.3 $\mu$A/cm$^2$ indicates that the oxygen introduction is low and that the local etching is not effected thus not increasing the specific surface area.

The present inventors completed the invention by increasing the oxygen introduction free from forming weak boundary layers on the carbon fiber surface.

That is, the first electrolytic treatment for the carbon fibers is effected with an electrolyte capable of introducing oxygen together with formation of a brittle layer on the surface of the fiber, then, the second electrolytic treatment is effected by using electrolytes for smooth etching to remove off the surface brittle layer.

In the case of using the same electrolyte, the process is somewhat different according to the concentration. In the case of using ammonium carbonate in the electrolytic solution having an electric conductivity of lower than 10 m·mho/cm for the second electrolytic treatment, for example, the treatment is more similar to that of the first using phosphoric or nitric acid. That is, both treatments readily introduce oxygen and form a weak boundary layer. A desirable second electrolytic treatment, i.e., a smooth etching free from weak boundary layer should be effected in an electrolytic solution in a concentration range which give 10 m·mho/cm or higher conductivity. More preferable is at an electric conductivity of not lower than 30 m·mho/cm.

In the first electrolytic treatment, on the other hand, there is no substantial difference arising from concentration of the electrolytic solution, however, from the viewpoint of industrial production, preferable is an electric conductivity of not lower than 5 m·mhocm.

Increased temperature in the first electrolytic treatment improves the carbon fiber strength.

Generally after a standard electrolytic treatment at lower than 60° C. treatment, the carbon fiber strength decreases for about 20 kg/mm$^2$ (differs according to the electrolytic electricity level) of an untreated carbon fiber. When it is treated at 60° C. or higher, preferably at a temperature not lower than 80° C., however, the strength inversely increases. The reason is not yet clarified, but is assumably attributed to the exclusion of the surface flaws by high-temperature treatment.

In the practical operation of the electrolytic treatment of the present invention, the applied quantity of electricity should be appropriately chosen according to the elastic modulus of the carbon fiber. In general, the quantity of electricity preferably is 10 to 500 coulomb/g for the first treatment and 25 to 1000 coulumb/g for the second treatment.

The present invention is effective for any kind of carbon fiber, however, there is no significant difference in the composite performance (ILSS, TS⊥, FS⊥, CAI) between the acrylic carbon fibers with low modulus of lower than 30 ton/mm$^2$ as described above subjected to two-step electrolytic treatment of the present invention and that with only the second treatment, since the second treatment is sufficient to incorporate oxygen onto the surface.

For carbon fibers with elastic modulus of not lower than 30 ton/mm$^2$, on the other hand, the composite performances are remarkably improved.

The Cyclic Voltammetry method is a method shown in Japanese Patent Application (OPI) No. 246864/85 (corresponding to British Patent No. 2161273B) and Japanese Patent Application (OPI) No. 252718/85 (corresponding to U.S. Pat. No. 4,603,157) by present inventors. The analytical apparatus commonly called "Voltammetric Analyzer" consists of a potentiostat and a function generator is used for the method employing a carbon fiber as the working electrode. In the present invention, 5% aqueous phosphoric acid solution controlled to pH 3.0 is used, and nitrogen is bubbled through the solution to obviate the effect of residual oxygen. An Ag/AgCl standard electrode as the reference electrode, a carbon fiber tow as the working electrode immersed in the electrolytic solution, and a platinum electrode as the counter electrode having a sufficient surface area, are used.

Samples may be in tow, sheet, cloth, paper, etc., in any form insofar as that it can be fixed as an electrode. It is also possible to measure with resin components such as sizing agents and matrix resin being adhered on the piece, however, it is desirable to remove off the resin by extraction in advance since this gives different results in the effective surface area. Although a tow of 12,000 filaments of 50 mm long was used as a standard form of the sample, the size is not limited thereto provided that the result is converted to the current intensity per unit area, ipa, as defined in the present invention.

The potential range applied between the carbon fiber electrode and the counter electrode should be set within a range not exceeding the electrolysis potential of water in the electrolyte solution. For instance, in 5% aqueous phosphoric acid solution, a range of -0.2 V to +0.8 V was taken as the standard. Since the intensity of current produced by potential scanning depends on the scanning rate, the rate must be always kept constant. In this invention, the rate of 2 mV/sec was chosen as the standard. Current-potential curves were plotted using an X—Y recorder. After sweeping 3 times or more until the curves were stably obtained, the current intensity was read off at a certain fixed potential relative to the reference electrode potential, at +0.4 V in this invention, and ipa was calculated from the equation as follows:

$$ipa = i(\mu A)/\left[\text{sample length (cm)} \times \left[\frac{4\pi \cdot \text{weight of fiber per length (g/cm)} \cdot \text{filament number}}{\text{density (g/cm}^3)}\right]^{\frac{1}{2}}\right]$$

An apparent surface area was calculated from the sample length, sample density and sample weight per unit length according to the method described in JIS-R7601, and then the current intensity was divided by the surface area thus obtained to give the ipa.

Table 1 gives the ipa measured by the Cyclic Voltammetry method for 1 g of carbon fiber obtained after electrolytic oxidation under 60 coulomb electricity.

Table 1 also gives the pH and the electric conductivity at 25° C. of electrolyte of 5% aqueous solution.

The carbon fiber used here was made under a condition similar to that described in Example 1 mentioned later.

TABLE 1

| Electrolyte 5% aqueous solution | pH | Electric conductivity of solution (m · mho/cm) | ipa ($\mu$A/cm$^2$) |
|---|---|---|---|
| Phosphoric acid | 1.6 | 27.5 | 0.88 |
| Nitric acid | 0.9 | 184.5 | 1.37 |
| Sulfuric acid | 0.8 | 216.2 | 0.52 |
| Potassium tertiary phosphate | 12.4 | 47.0 | 0.40 |
| Potassium secondary phosphate | 8.8 | 32.5 | 0.42 |
| Potassium primary phosphate | 4.3 | 28.1 | 0.54 |
| Sodium tertiary phosphate | 12.3 | 25.3 | 0.34 |
| Sodium secondary phosphate | 9.1 | 17.7 | 0.33 |
| Sodium primary phosphate | 4.3 | 17.8 | 0.39 |
| Ammonium tertiary phosphate | 9.1 | 30.3 | 0.35 |
| Ammonium secondary phosphate | 8.0 | 42.4 | 0.35 |
| Ammonium primary phosphate | 4.1 | 30.7 | 0.53 |
| Potassium nitrate | 5.5 | 49.7 | 1.05 |
| Sodium nitrate | 5.4 | 50.5 | 0.96 |
| Ammonium nitrate | 4.8 | 48.1 | 1.13 |
| Potassium sulfate | 6.4 | 52.7 | 0.77 |
| Sodium sulfate | 5.9 | 48.1 | 0.61 |
| Ammonium sulfate | 5.3 | 62.5 | 0.63 |
| Sodium hydroxide | 12.8 | 142.0 | 0.17 |
| Potassium hydroxide | 13.2 | 144.2 | 0.14 |

TABLE 1-continued

| Electrolyte 5% aqueous solution | pH | Electric conductivity of solution (m · mho/cm) | ipa ($\mu$A/cm$^2$) |
|---|---|---|---|
| Ammonium carbonate | 8.5 | 32.7 | 0.20 |
| Ammonium hydrogencarbonate | 7.5 | 34.3 | 0.21 |
| Barium hydroxide (3%) | 12.7 | 27.5 | 0.16 |

As is apparent from Table 1, the electrolytes with ipa of not lower than 0.3 $\mu$A/cm$^2$ are suitably used for the first electrolytic treatment in the present invention, whereas those lower than 0.3 $\mu$A/cm$^2$ are suitable for the second treatment in the present invention.

EXAMPLE

This invention will be described in more detail below with reference to Examples. Unless otherwise indicated, all percents are by weight.

Strand strength and modulus were determined according to the method defined in JIS-R7601, ILSS (interlayer shear strength) to that defined in ASTM-D2344, FS⊥ (bending strength in the direction making a right angle with the fiber direction) to that defined in ASTM-D790, and TS⊥ (tensile strength in the direction making a right angle with the fiber direction) to that defined in ASTM-D3039.

The test piece was prepared from a thoroughly washed carbon fiber and an epoxy type matrix resin (Pyrofil® #340, produced by Mitsubishi Rayon Co., Ltd.).

EXAMPLE 1

An acrylonitrile/metacrylic acid copolymer (98/2 by weight ratio) was dissolved in dimethylformamide to give a dope with solid concentration of 26 wt%, subjected to wet spinning after 10-$\mu$m and 3-$\mu$m filtration, drawn to 4.5 times in hot water, washed and dired, and further drawn to 1.7 times under dry air at 170° C. to give a precursor with 12,000 filaments having fineness of 0.9 denier.

The precursor was passed through a flame-resisting treatment furnace of hot-air circulation type at 220 to 260° C. over 60 minutes to give a flame-resisting fiber with density of 1.35 g/cm$^3$. During the treatment, an elongation of 15% was applied to the fiber.

The fiber was further passed through the carbonization furnace having a temperature gradient of 300 to 600° C. under pure nitrogen stream with applying an elongation of 8%.

The fiber above was then heat treated under a tension of 400 mg/denier for 2 minutes in the second carbonization furnace with the maximum temperature of 1800° C. under the same atmosphere as that of the first carbonization treatment to give the carbon fiber. This carbon fiber without surface treatment has strand strength of 550 kg/mm$^2$ and strand modulus of 34.5 ton/mm$^2$. The carbon fiber as the anode was first treated in 5% aqueous phosphoric acid solution controlled to pH 1 at 80° C., by applying electricity of 25 coulomb per 1 gram of carbon fiber, and then was second treated in a 5% aqueous ammonium hydrogencarbonate solution controlled to pH 7.5 at 30° C., by applying electricity of 100 coulomb per 1 gram of carbon fiber to obtain a carbon fiber subjected to the treatment of the present invention.

The carbon fiber after the treatment gave excellent composite performance of strand strength of 600 kg/mm$^2$, strand modulus of 34.8 ton/mm$^2$, ILSS of 9.2 kg/mm$^2$, FS⊥ of 8.9 kg/mm$^2$, and TS⊥ of 8.0 kg/mm$^2$.

EXAMPLE 2

The same carbon fiber as used in Example 1 was treated in the same manner as in Example 1 except that the applied electricity in the first and the second electrolytic treatments were changed as shown in Table 2. The carbon fibers treated in accordance with the present invention gave excellent composite performance as shown in Table 2.

TABLE 2

| No. | First Treatment | Second Treatment | Strand Strength (kg/mm$^2$) | Strand modulus (ton/mm$^2$) | ILSS (kg/mm$^2$) | FS⊥ (kg/mm$^2$) | TS⊥ (kg/mm$^2$) |
|---|---|---|---|---|---|---|---|
| 1 | 5% Phosphoric acid 80° C. 50 coulomb/g | 5% Ammonium hydrogen-carbonate 30° C. 100 coulomb/g | 630 | 34.9 | 8.9 | 8.7 | 7.6 |
| 2 | 5% Phosphoric acid 80° C. 100 coulomb/g | 5% Ammonium hydrogen-carbonate 30° C. 100 coulomb/g | 640 | 34.9 | 9.2 | 8.8 | 7.0 |
| 3 | 5% Phosphoric acid 80° C. 250 coulomb/g | 5% Ammonium hydrogen-carbonate 30° C. 100 coulomb/g | 626 | 34.8 | 9.0 | 9.0 | 7.1 |
| 4 | 5% Phosphoric acid 80° C. 25 coulomb/g | 5% Ammonium hydrogen-carbonate 30° C. 25 coulomb/g | 650 | 35.2 | 8.8 | 9.1 | 7.1 |
| 5 | 5% Phosphoric acid 80° C. 20 coulomb/g | 5% Ammonium hydrogen-carbonate 30° C. 50 coulomb/g | 635 | 34.8 | 9.0 | 8.7 | 6.9 |
| 6 | 5% Phosphoric acid 80° C. 20 coulomb/g | 5% Ammonium hydrogen-carbonate 30° C. 100 coulomb/g | 621 | 34.7 | 9.5 | 9.1 | 7.5 |
| 7 | 5% Phosphoric acid 80° C. 25 coulomb/g | 5% Ammonium hydrogen-carbonate 30° C. 200 coulomb/g | 622 | 34.8 | 9.3 | 9.0 | 7.2 |

EXAMPLE 3

The same carbon fiber as used in Example 1 was treated in the same manner as in Example 1 except that the applied electricity in the first electrolytic treatment and the electrolyte and the applied electricity in the second electrolytic treatment were changed as shown in Table 3. The carbon fibers treated in accordance with the present invention gave excellent composite performance as shown in Table 3.

TABLE 3

| No. | First Treatment | Second Treatment | Strand Strength (kg/mm$^2$) | Strand modulus (ton/mm$^2$) | ILSS (kg/mm$^2$) | FS⊥ (kg/mm$^2$) | TS⊥ (kg/mm$^2$) |
|---|---|---|---|---|---|---|---|
| 8 | 5% Phosphoric acid 80° C. 25 coulomb/g | 5% Sodium hydroxide 30° C. 100 coulomb/g | 625 | 34.8 | 9.1 | 8.7 | 7.2 |
| 9 | 5% Phosphoric acid 80° C. 50 coulomb/g | 5% Sodium hydroxide 30° C. 100 coulomb/g | 610 | 34.7 | 9.0 | 8.9 | 7.3 |
| 10 | 5% Phosphoric acid 80° C. 100 coulomb/g | 5% Sodium hydroxide 30° C. 100 coulomb/g | 598 | 34.6 | 9.2 | 9.0 | 7.6 |
| 11 | 5% Phosphoric acid 80° C. 250 coulomb/g | 5% Sodium hydroxide 30° C. 100 coulomb/g | 590 | 34.6 | 9.1 | 8.8 | 7.1 |
| 12 | 5% Phosphoric acid 80° C. 25 coulomb/g | 5% Potassium hydroxide 30° C. 100 coulomb/g | 630 | 34.8 | 9.0 | 9.0 | 7.3 |
| 13 | 5% Phosphoric acid 80° C. 25 coulomb/g | 3% Barium hydroxide 30° C. 100 coulomb/g | 634 | 34.8 | 9.2 | 8.8 | 7.2 |

EXAMPLE 4

The same carbon fiber as used in Example 1 was treated in the same manner as in Example 1 except that the electrolyte of the first electrolytic treatment was changed as shown in Table 4. The carbon fibers treated in accordance with the present invention gave excellent composite performance as shown in Table 4.

TABLE 4

| No. | First Treatment | Second Treatment | Strand Strength (kg/mm$^2$) | Strand modulus (ton/mm$^2$) | ILSS (kg/mm$^2$) | FS⊥ (kg/mm$^2$) | TS⊥ (kg/mm$^2$) |
|---|---|---|---|---|---|---|---|
| 14 | 5% Ammonium primary phosphate | 5% Ammonium hydrogencarbonate | 610 | 34.7 | 8.9 | 8.7 | 7.7 |

TABLE 4-continued

| No. | First Treatment | Second Treatment | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|---|
| | 80° C. 25 coulomb/g | 30° C. 100 coulomb/g | | | | | |
| 15 | 5% Ammonium secondary phosphate 80° C. 25 coulomb/g | 5% Ammonium hydrogencarbonate 30° C. 100 coulomb/g | 605 | 34.7 | 9.0 | 9.2 | 7.6 |
| 16 | 5% Ammonium tertiary phosphate 80° C. 25 coulomb/g | 5% Ammonium hydrogencarbonate 30° C. 100 coulomb/g | 620 | 35.0 | 9.0 | 9.1 | 7.7 |
| 17 | 5% Potassium primary phosphate 80° C. 25 coulomb/g | 5% Ammonium hydrogencarbonate 30° C. 100 coulomb/g | 600 | 34.8 | 9.1 | 9.2 | 7.6 |
| 18 | 5% Potassium secondary phosphate 80° C. 25 coulomb/g | 5% Ammonium hydrogencarbonate 30° C. 100 coulomb/g | 612 | 34.9 | 9.0 | 8.9 | 7.3 |
| 19 | 5% Potassium tertiary phosphate 80° C. 25 coulomb/g | 5% Ammonium hydrogencarbonate 30° C. 100 coulomb/g | 621 | 35.0 | 9.1 | 9.0 | 7.7 |
| 20 | 5% Sodium primary phosphate 80° C. 25 coulomb/g | 5% Ammonium hydrogencarbonate 30° C. 100 coulomb/g | 602 | 34.0 | 9.0 | 8.9 | 7.4 |
| 21 | 5% Sodium secondary phosphate 80° C. 25 coulomb/g | 5% Ammonium hydrogencarbonate 30° C. 100 coulomb/g | 609 | 34.8 | 9.1 | 9.1 | 7.7 |
| 22 | 5% Sodium tertiary phosphate 80° C. 25 coulomb/g | 5% Ammonium hydrogencarbonate 30° C. 100 coulomb/g | 611 | 34.7 | 9.1 | 8.9 | 7.3 |
| 23 | 5% Nitric acid 80° C. 25 coulomb/g | 5% Ammonium hydrogencarbonate 30° C. 100 coulomb/g | 641 | 35.1 | 9.1 | 9.0 | 7.6 |
| 24 | Ammonium nitrate 80° C. 25 coulomb/g | 5% Ammonium hydrogencarbonate 30° C. 100 coulomb/g | 643 | 35.1 | 9.0 | 9.0 | 7.6 |
| 25 | 5% Potassium nitrate 80° C. 25 coulomb/g | 5% Ammonium hydrogencarbonate 30° C. 100 coulomb/g | 630 | 35.0 | 9.1 | 9.0 | 7.5 |
| 26 | 5% Sodium nitrate 80° C. 25 coulomb/g | 5% Ammonium hydrogencarbonate 30° C. 100 coulomb/g | 626 | 35.0 | 8.8 | 8.9 | 7.3 |

EXAMPLE 5

The same carbon fiber as used in Example 1 was treated in the same manner as in Example 1 except that the electrolytes of both the first and the second electrolytic treatments were changed as shown in Table 5. The carbon fibers treated in accordance with the present invention gave excellent composite performance as shown in Table 5.

TABLE 5

| No. | First Treatment | Second Treatment | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|---|
| 27 | 5% Ammonium tertiary phosphate 80° C. 25 coulomb/g | Sodium hydroxide 5% 30° C. 100 coulomb/g | 643 | 34.9 | 9.2 | 9.0 | 7.6 |
| 28 | 5% Potassium tertiary phosphate 80° C. 25 coulomb/g | Sodium hydroxide 5% 30° C. 100 coulomb/g | 645 | 34.9 | 9.2 | 9.0 | 7.4 |
| 29 | 5% Sodium tertiary phosphate 80° C. 25 coulomb/g | Sodium hydroxide 5% 30° C. 100 coulomb/g | 640 | 34.8 | 9.1 | 8.9 | 7.3 |
| 30 | 5% Ammonium nitrate 80° C. 25 coulomb/g | Sodium hydroxide 5% 30° C. 100 coulomb/g | 654 | 34.9 | 9.2 | 9.1 | 7.5 |

TABLE 5-continued

| No. | First Treatment | Second Treatment | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|---|
| 31 | 5% Potassium nitrate 80° C. 25 coulomb/g | Soduim hydroxide 5% 30° C. 100 coulomb/g | 630 | 34.8 | 9.0 | 8.8 | 7.3 |
| 32 | 5% Sodium nitrate 80° C. 25 coulomb/g | Sodium hydroxide 5% 30° C. 100 coulomb/g | 622 | 34.7 | 9.0 | 9.0 | 7.4 |
| 33 | Phosphoric acid 2.5% + Nitric acid 2.5% 80° C. 25 coulomb/g | Sodium hydroxide 5% 30° C. 100 coulomb/g | 645 | 34.9 | 9.2 | 9.0 | 7.4 |
| 34 | Ammonium tertiary phosphate 2.5% + Ammonium nitrate 2.5% 80° C. 25 coulomb/g | Sodium hydroxide 5% 30° C. 100 coulomb/g | 652 | 34.9 | 9.2 | 9.1 | 7.5 |
| 35 | Potassium tertiary phosphate 2.5% + Potassium nitrate 2.5% 80° C. 25 coulomb/g | Sodium hydroxide 5% 30° C. 100 coulomb/g | 620 | 34.7 | 9.1 | 8.8 | 7.3 |
| 36 | Sodium tertiary phosphate 2.5% + Sodium nitrate 2.5% 80° C. 25 coulomb/g | Sodium hydroxide 5% 30° C. 100 coulomb/g | 610 | 34.7 | 9.0 | 8.8 | 7.2 |
| 37 | Phosphoric acid 5% 80° C. 25 coulomb/g | Ammonium hydrogen-carbonate 2.5% + Sodium hydroxide 2.5% 30° C. 100 coulomb/g | 631 | 34.9 | 9.1 | 8.9 | 7.3 |
| 38 | Phosphoric acid 5% 80° C. 25 coulomb/g | Ammonium hydrogen-carbonate 2.5% + Potassium hydroxide 2.5% 30° C. 100 coulomb/g | 632 | 34.9 | 9.0 | 8.8 | 7.2 |
| 39 | Phosphoric acid 5% 80° C. 25 coulomb/g | Ammonium hydrogen-carbonate 2.5% + Calcium hydroxide 0.1% 30° C. 100 coulomb/g | 628 | 34.9 | 9.2 | 9.0 | 7.4 |
| 40 | Phosphoric acid 5% 80° C. 25 coulomb/g | Sodium hydroxide 2.5% + Potassium hydroxide 2.5% 30° C. 100 coulomb/g | 623 | 34.8 | 9.0 | 8.9 | 7.3 |

COMPARATIVE EXAMPLE 1

The same carbon fiber as used in Example 1 was treated in the same manner as in Example 1 except that the electrolytic treatment was changed to effect in one step using the electrolyte and applied electricity as shown in Table 6 to obtain carbon fibers with properties listed in Table 6.

TABLE 6

| Run No. | Electrolytic Oxidation Condition | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|
| 41 (Comparative sample) | Phosphoric acid 5% 80° C. 25 coulomb/g | 500 | 34.4 | 8.5 | 5.6 | 4.5 |
| 42 (Comparative sample) | Phosphoric acid 5% 80° C. 50 coulomb/g | 497 | 34.3 | 8.4 | 5.2 | 4.0 |
| 43 (Comparative sample) | Phosphoric acid 5% 80° C. 100 coulomb/g | 492 | 34.3 | 8.4 | 4.8 | 3.5 |
| 44 (Comparative sample) | Ammonium tertiary phosphate 5% 80° C. 25 coulomb/g | 510 | 34.4 | 8.6 | 5.7 | 4.8 |
| 45 (Comparative sample) | Potassium tertiary phosphate 5% 80° C. 25 coulomb/g | 506 | 34.4 | 8.2 | 5.2 | 4.3 |
| 46 (Comparative sample) | Sodium tertiary phosphate 5% 80° C. 25 coulomb/g | 508 | 34.4 | 8.2 | 4.9 | 4.1 |
| 47 (Comparative | Nitric acid 5% 80° C. 25 coulomb/g | 610 | 34.8 | 8.5 | 5.1 | 4.6 |

TABLE 6-continued

| Run No. | Electrolytic Oxidation Condition | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|
| sample) | | | | | | |
| 48 (Comparative sample) | Nitric acid 5% 80° C. 50 coulomb/g | 612 | 34.9 | 8.4 | 5.0 | 4.3 |
| 49 (Comparative sample) | Nitric acid 5% 80° C. 100 coulomb/g | 607 | 34.7 | 8.6 | 4.8 | 4.6 |
| 50 (Comparative sample) | Ammonium nitrate 5% 80° C. 25 coulomb/g | 611 | 34.7 | 8.6 | 5.2 | 4.6 |
| 51 (Comparative sample) | Potassium nitrate 5% 80° C. 25 coulomb/g | 540 | 34.5 | 8.4 | 4.7 | 4.1 |
| 52 (Comparative sample) | Sodium nitrate 5% 80° C. 25 coulomb/g | 533 | 34.5 | 8.2 | 4.5 | 3.8 |
| 53 (Comparative sample) | Ammonium hydrogencarbonate 5% 30° C. 25 coulomb/g | 520 | 34.6 | 8.5 | 7.1 | 6.3 |
| 54 (Comparative sample) | Ammonium hydrogencarbonate 5% 30° C. 50 coulomb/g | 508 | 34.5 | 8.6 | 7.3 | 6.3 |
| 55 (Comparative sample) | Ammonium hydrogencarbonate 5% 30° C. 100 coulomb/g | 502 | 34.5 | 8.6 | 7.6 | 6.4 |
| 56 (Comparative sample) | Ammonium carbonate 5% 30° C. 100 coulomb/g | 498 | 34.4 | 8.6 | 7.6 | 6.3 |
| 57 (Comparative sample) | Sodium hydroxide 5% 30° C. 100 coulomb/g | 485 | 34.3 | 8.7 | 7.5 | 6.3 |
| 58 (Comparative sample) | Potassium hydroxide 5% 30° C. 100 coulomb/g | 492 | 34.4 | 8.6 | 7.6 | 6.2 |

COMPARATIVE EXAMPLE 2

The same carbon fiber as used in Example 1 was treated in the same manner as in Example 1 except that both the electrolyte and the applied electricity were changed both in the first and the second electrolytic treatments to be the inverse of the present invention as shown in Table 7 to obtain carbon fibers with properties listed in Table 7.

TABLE 7

| No. | First Treatment | Second Treatment | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|---|
| 59 (Comparative sample) | Ammonium hydrogen-carbonate 5% 30° C. 100 coulomb/g | Phosphoric acid 5% 80° C. 25 coulomb/g | 522 | 34.4 | 8.7 | 6.1 | 5.2 |
| 60 (Comparative sample) | Ammonium hydrogen-carbonate 5% 30° C. 50 coulomb/g | Phosphoric acid 5% 80° C. 25 coulomb/g | 531 | 34.4 | 8.5 | 5.9 | 4.5 |
| 61 (Comparative sample) | Ammonium hydrogen-carbonate 5% 30° C. 20 coulomb/g | Phosphoric acid 5% 80° C. 25 coulomb/g | 546 | 34.8 | 8.6 | 6.2 | 4.3 |
| 62 (Comparative sample) | Ammonium hydrogen-carbonate 5% 30° C. 100 coulomb/g | Phosphoric acid 5% 80° C. 50 coulomb/g | 524 | 34.3 | 8.5 | 5.6 | 4.2 |
| 63 (Comparative sample) | Ammonium hydrogen-carbonate 5% 30° C. 100 coulomb/g | Phosphoric acid 5% 80° C. 100 coulomb/g | 511 | 34.3 | 8.6 | 4.9 | 3.7 |
| 64 (Comparative sample) | Ammonium hydrogen-carbonate 5% 30° C. 100 coulomb/g | Phosphoric acid 5% 80° C. 200 coulomb/g | 509 | 34.1 | 8.6 | 4.5 | 3.6 |
| 65 (Comparative sample) | Sodium hydroxide 5% 30° C. 100 coulomb/g | Phosphoric acid 5% 80° C. 25 coulomb/g | 563 | 34.6 | 8.6 | 6.0 | 5.2 |
| 66 (Comparative sample) | Sodium hydroxide 5% 30° C. 50 coulomb/g | Phosphoric acid 5% 80° C. 25 coulomb/g | 552 | 34.5 | 8.5 | 5.9 | 4.8 |

TABLE 7-continued

| No. | First Treatment | Second Treatment | Strand Strength (kg/mm²) | Strand modulus (ton/mm²) | ILSS (kg/mm²) | FS⊥ (kg/mm²) | TS⊥ (kg/mm²) |
|---|---|---|---|---|---|---|---|
| 67 (Comparative sample) | Sodium hydroxide 5% 30° C. 20 coulomb/g | Phosphoric acid 5% 80° C. 25 coulomb/g | 546 | 34.5 | 8.5 | 5.9 | 4.7 |
| 68 (Comparative sample) | Sodium hydroxide 5% 30° C. 100 coulomb/g | Phosphoric acid 5% 80° C. 50 coulomb/g | 554 | 34.6 | 8.4 | 5.7 | 4.6 |
| 69 (Comparative sample) | Sodium hydroxide 5% 30° C. 100 coulomb/g | Phosphoric acid 5% 80° C. 100 coulomb/g | 520 | 34.4 | 8.3 | 5.5 | 4.2 |
| 70 (Comparative sample) | Sodium hydroxide 5% 30° C. 100 coulomb/g | Phosphoric acid 5% 80° C. 200 coulomb/g | 515 | 34.3 | 8.4 | 5.5 | 4.1 |

As is apparent from the results of Tables 1 to 7, the carbon fibers subjected to surface treatment in two steps, in accordance with the present invention are excellent in composite performance.

COMPARATIVE EXAMPLE 3

The carbon fiber was obtained similarly Example 1 except that the second furnace temperature was changed to 1200° C. instead of 1800° C. This carbon fiber without surface treatment has strand strength of 540 kg/mm² and strand modulus of 26.1 ton/mm². Then this carbon fiber was treated in the same manner as in Example 1 or Comparative Example 1 to obtain carbon fibers with properties listed in Table 8.

TABLE 8

| No. | First Treatment | Second Treatment | Strand Strength (kg/mm²) | Strand Modulus (ton/mm²) | ILSS (kg/mm²) | FS⊥ (kg/mm²) | TS⊥ (kg/mm²) |
|---|---|---|---|---|---|---|---|
| 71 (Comparative sample) | 5% Phosphoric acid 80° C. | 5% Ammonium hydrogen-carbonate 30° C. | 580 | 26.3 | 9.0 | 9.1 | 7.5 |
| 72 (Comparative sample) | 5% Ammonium hydrogen-carbonate 30° C. | — | 530 | 26.1 | 9.1 | 9.0 | 7.3 |

As is apparent from the results of Table 8, in the carbon fibers of modulus loewr than 30 ton/mm², similar results are obtained in one-step treatment or two-step treatment, and the present invention is effective to the carbon fibers of which modulus is not lower than 30 ton/mm².

While the invention has been described in detail and with reference to specific embodiments thereof, it will be apparent to one skilled in the art that various changes and modifications can be made therein without departing from the spirit and scope thereof.

What is claimed is:

1. A process for the surface treatment of carbon fiber having a modulus of not less than 30 ton/mm², in two steps, which comprises the steps of:

subjecting a carbon fiber as an anode to a first electrolytic treatment in an aqueous solution at a temperature of not less than 60° C. of an inorganic acidic electrolyte or an neutral salt electrolyte; and then subjecting the treated fiber to a second electrolytic treatment in an aqueous solution of an ammonium salt of carbonic acid or of an inorganic alkaline electrolyte.

2. The process as in claim 1, wherein the electric conductivity of the aqueous electrolytic solution for the second electrolytic treatment is not less than 10 m·mho/cm.

3. The process as in claim 1, wherein the electrolyte for the first electrolytic treatment is selected from the group consisting of phosphoric acid, nitric acid, and sulfuric acid.

4. The process as in claim 1, wherein the electrolyte for the first electrolytic treatment is selected from the group consisting of potassium primary phosphate, potassium secondary phosphate, potassium tertiary phosphate, sodium primary phosphate, sodium secondary phosphate, sodium tertiary phosphate, potassium nitrate, sodium nitrate, potassium sulfate, sodium sulfate, potassium hydrogensulfate, and sodium hydrogensulfate.

5. The process as in claim 1, wherein the electrolyte for the first electrolytic treatment is selected from the group consisting of ammonium primary phosphate, ammonium secondary phosphate, ammonium tertiary phosphate, ammonium sulfate, ammonium hydrogensulfate, and ammonium nitrate.

6. The process as in claim 1, wherein the electrolyte for the second electrolytic treatment is selected from the group consisting of sodium hydroxide and potassium hydroxide.

7. The process as in claim 1, wherein the electrolyte for the second electrolytic treatment is selected from the group consisting of ammonium carbonate and ammonium hydrogencarbonate.

8. The process as in claim 1, wherein the electrolyte for the second electrolytic treatment is selected from the group consisting barium hydroxide, calcium hydroxide, and magnesium hydroxide.

9. The process as in claim 1, wherein the electrolyte of the first electrolytic treatment gives an ipa of not less than 0.3 μA/cm² as measured by cyclic voltammetry, as the electrolyte is employed in the electrolytic oxidation of one gram of carbon fiber at 60 coulombs of electricity.

10. The process as in claim 1, wherein the electrolyte of the second electrolytic treatment gives an ipa of not less than 0.3 $\mu A/cm^2$ as measured by cyclic voltammetry, as the electrolyte is employed in the electrolytic oxidation of one gram of carbon fiber at 60 coulombs of electricity.

* * * * *